US008616026B2

(12) United States Patent
Yoon et al.

(10) Patent No.: US 8,616,026 B2
(45) Date of Patent: Dec. 31, 2013

(54) CONTROL PANEL ASSEMBLY FOR LAUNDRY DEVICE AND LAUNDRY DEVICE INCLUDING THE SAME

(75) Inventors: Ju Han Yoon, Changwon-si (KR); Sung Gi Hwang, Changwon-si (KR); Seong Kyu Kim, Changwon-si (KR); Seon Il Heo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 969 days.

(21) Appl. No.: 12/439,482

(22) PCT Filed: Aug. 21, 2007

(86) PCT No.: PCT/KR2007/003979

§ 371 (c)(1), (2), (4) Date: Feb. 9, 2010

(87) PCT Pub. No.: WO2008/026844

PCT Pub. Date: Mar. 6, 2008

(65) Prior Publication Data

US 2010/0139329 A1 Jun. 10, 2010

(30) Foreign Application Priority Data

Aug. 31, 2006 (KR) ..... 10-2006-0083380
Aug. 31, 2006 (KR) ..... 10-2006-0083381
Aug. 31, 2006 (KR) ..... 10-2006-0083382

(51) Int. Cl.

*D06F 39/00* (2006.01)
*D06F 29/00* (2006.01)
*D06F 35/00* (2006.01)
*H01H 9/00* (2006.01)

(52) U.S. Cl.

USPC ..... 68/12.27; 200/310; 200/312; 200/313; 200/314

(58) Field of Classification Search

USPC ..... 68/12.24, 12.27; 200/310, 312, 313, 200/314

See application file for complete search history.

(56) References Cited

U.S. PATENT DOCUMENTS 4,163,883 A 8/1979 Boulanger
4,315,114 A 2/1982 Monti, Jr.

(Continued)

FOREIGN PATENT DOCUMENTS

CN 1592014 A 3/2005
CN 1218338 C 9/2005

(Continued)

OTHER PUBLICATIONS

KR 10-2004-011970 Foreign Patent Feb. 2004 Korea Kim et al.*

(Continued)

*Primary Examiner* — Michael Kornakov
*Assistant Examiner* — Charles W Kling
(74) *Attorney, Agent, or Firm* — Birch, Stewart, Kolasch & Birch, LLP

(57) ABSTRACT

An improved control panel assembly is easy to fabricate, and easy to recognize a selected operation condition, and a laundry device with the same. The control panel assembly for a laundry device includes a button assembly having a plurality of buttons provided in correspondence to operation conditions, a control panel having a plurality of mounting holes for exposure of the plurality of buttons therethrough from a front thereof, and a frame on a rear of the control panel, the frame joining the plurality of buttons as one unit, and preventing pressing interference between adjacent buttons.

4 Claims, 6 Drawing Sheets

(56) References Cited

U.S. PATENT DOCUMENTS

| | | | | |
|---|---|---|---|---|
| 4,418,398 | A | 11/1983 | Hornung | |
| 4,510,778 | A * | 4/1985 | Cotton | 68/12.15 |
| 5,477,024 | A | 12/1995 | Share et al. | |
| 5,500,497 | A | 3/1996 | Merriman | |
| 5,585,704 | A | 12/1996 | Elzind | |
| 6,169,256 | B1 | 1/2001 | Hanahara et al. | |
| 6,326,569 | B1 | 12/2001 | Ardrey et al. | |
| 6,558,013 | B2 | 5/2003 | Tholin et al. | |
| 6,982,389 | B2 | 1/2006 | Riecke et al. | |
| 7,394,033 | B2 | 7/2008 | Kim | |
| 2002/0021562 | A1 | 2/2002 | Tholin et al. | |
| 2003/0010610 | A1 * | 1/2003 | Riecke et al. | 200/5 A |
| 2005/0138972 | A1 * | 6/2005 | Park | 68/3 R |
| 2005/0145468 | A1 * | 7/2005 | Kim | 200/296 |
| 2006/0001648 | A1 | 1/2006 | Kim et al. | |
| 2006/0102457 | A1 * | 5/2006 | Chen et al. | 200/345 |

FOREIGN PATENT DOCUMENTS

| | | | |
|---|---|---|---|
| DE | 198 14 446 | A1 | 10/1999 |
| EP | 1 176 619 | A2 | 1/2002 |
| EP | 1 179 828 | A1 | 2/2002 |
| EP | 1 511 050 | | 3/2005 |
| JP | 08-235957 | A | 9/1996 |
| KR | 10-2004-0011970 | A | 2/2004 |
| KR | 2004011970 | A * | 2/2004 |
| KR | 10-2004-0059681 | A | 7/2004 |
| KR | 10-2005-0037059 | A | 4/2005 |
| KR | 10-2005-0054204 | A | 6/2005 |
| KR | 10-2005-0081462 | A | 8/2005 |
| WO | WO 99/50809 | A2 | 10/1999 |

OTHER PUBLICATIONS

KR 10-2004-011970 Machine Translation Feb. 2004 Korea Kim et al.*

* cited by examiner

CONTROL PANEL ASSEMBLY FOR LAUNDRY DEVICE AND LAUNDRY DEVICE INCLUDING THE SAME

TECHNICAL FIELD

The present invention relates to control panel assemblies for laundry devices and laundry devices with the same. More specifically, the present invention relates to an improved control panel assembly which is easy to fabricate, and easy to recognize a selected operation condition, and a laundry device with the same.

BACKGROUND ART

The present invention relates to control panel assemblies for laundry devices and laundry devices with the same. More specifically, the present invention relates to an improved control panel assembly which is easy to fabricate, and easy to recognize a selected operation condition, and a laundry device with the same.

In general, washing machines for washing and spinning laundry, dryers for drying the laundry, and washing and drying machines both for washing and drying are called as the laundry devices, collectively.

The dryer is an appliance for heating dry air with heating means, blowing the dried air to a drum, for evaporating moisture from a drying object.

In general, though washed laundry is transferred to a drying rack for drying the laundry naturally, people of modern times who have busy daily lives experience inconvenience due to delay of the natural drying on a rainy season, or on unsettled days.

Consequently, a device is required, which can dry the laundry regardless of weather, owing to which the dryer has been developed.

It is a trend that demands on the dryer of the modern time people of busy daily lives increase, rapidly.

Of the related art laundry machine, a related art dryer will be described with reference to FIGS. 1 and 2.

Referring to FIG. 1, the dryer is provided with a body case 1 which forms an exterior of the dryer, and a control panel 2 on an upper portion of a front of the body case 1 for operation of the dryer.

The body case 1 has a door 3 provided to the front, and a drum (not shown) mounted in the body case 1. Accordingly, the user puts/takes the laundry in/out of the drum through the door 3. The drum holds the laundry, and dries the laundry as the drum rotates at an appropriate speed. Of course, in case of the washing machine, the laundry is washed in the drum.

Referring to FIG. 2, the control panel 2 is provided with a plurality of buttons 21 for operation conditions, and a display window 22 and LED lamps 23 for displaying a selected operation condition or operation state.

The buttons are for higher rank items which are functions of the dryer, for an example, selection buttons 21*a* for selecting dryness, temperature, drying time period, and so on (hereafter called as higher rank operation conditions), a power button 21*b* for applying power to the dryer, and a pause button 21*c* for stopping the dryer temporarily.

The plurality of LED lamps 23 are provided dependent on the selection buttons 21 respectively, for indicating lower rank items of the dryer, for an example, numerals of a time, numerals of a temperature, and so on (hereafter called as lower operation conditions) which indicate levels of the higher rank items, following pressing of the selection buttons 21*a*, and character portions are printed on fronts of the buttons 21 or on an outside of the control panel 2 close to the buttons 21 and the LED lamps 23, for identifying the operation conditions.

DISCLOSURE OF INVENTION

Technical Problem

However, the related art dryer has the following problems.

First, the plurality of times of pressing down of the selection buttons 21*a* required for selecting a lower rank operation condition dependent on a higher rank condition is cumbersome in operation of the buttons.

If an unwanted lower rank condition is selected due to pressing of a wrong selection button 21*a*, it is required to press the buttons again after returning to an original position of the lower rank operation condition by pressing the selection buttons 21*a* many times.

Second, the character portions printed for identifying operation conditions of the dryer are erased due to frequent contact with user's fingers.

Of course, for preventing this, the character portions may be carved with a laser beam so that the character portions are not erased despite of the user's physical contact, this laser carving increases steps of process and causes addition of a carving cost.

Technical Solution

To solve the problems, an object of the present invention is to provide a control panel assembly of a laundry device in which operation of buttons is simple, operated buttons can be identified easily, and endurance of character portions on the button assembly is improved.

Another object of the present invention is to provide control panel assembly which can indicate an operation condition the user selects clearly, and a laundry device with the same.

Another object of the present invention is to provide control panel assembly which can prevent a plurality of buttons from interfering to one another for preventing mal-operation in advance, and a laundry device with the same.

Another object of the present invention is to provide control panel assembly in which a plurality of buttons are fabricated as one unit and locations of the buttons are modified for providing better appearance, and a laundry device with the same.

To achieve these objects and other advantages and in accordance with the purpose of the invention, as embodied and broadly described herein, a control panel assembly for a laundry device includes a button assembly having a plurality of buttons provided in correspondence to operation conditions, a control panel having a plurality of mounting holes for exposure of the plurality of buttons therethrough from a front thereof, and a frame on a rear of the control panel, the frame jointing the plurality of buttons as one unit, and preventing pressing interference between adjacent buttons.

The frame may include an outer frame which forms a rim of the button assembly, and inner frames arranged in a width or a height direction in the outer frame. Preferably, the inner frame is projected in a rear direction beyond a rear of the button. The inner frame is projected to a height the same with a backward maximum moving distance of the button.

That is, by increasing the height of projection of the inner frame, pressing of the button even in a case a place between adjacent buttons, for an example, a front of the control panel between the mounting holes is pressed.

Preferably, each of the buttons includes an indicating unit for indicating a selected operation condition. Preferably, the indicating unit is projected from a front to a rear of the button to form a light path.

Preferably, the indicating unit is formed of a transparent material by double injection molding. The indicating unit is formed of a material different from a material of the button or has a color different from a color of the button even though the indicating unit is formed of a material the same with a material of the button.

In another aspect of the present invention, a control panel assembly includes a control panel having a plurality of mounting holes, a button assembly including a plurality of buttons provided in a number the same with a number of a plurality of operation conditions for being exposed from a front of the control panel through the mounting holes, and a frame on a rear of the control panel for jointing the plurality of buttons as one unit within the frame, and an interference preventive portion on a rear of the button assembly for preventing pressing interference between adjacent buttons.

The interference preventive portion may be formed at a board guide, or the lamp supporter.

In another aspect of the present invention, a laundry device includes an exterior case which forms an exterior of the laundry device, a drum mounted in the exterior case for holding laundry, a control panel having a plurality of mounting holes, a button assembly including a plurality of buttons exposed from a front of the control panel through the mounting holes for a user to select an operation condition by pressing the button, and a frame on a rear of the control panel for jointing the plurality of buttons as one unit within the frame, and an interference preventive portion on a rear of the button assembly for preventing pressing interference between adjacent buttons.

Advantageous Effects

The present invention has following advantageous effects.

The plurality of buttons provided in a number the same number with a plurality of operation conditions permits user's easy operation of the buttons because what is required is to press the buttons only once for each time of operation.

The single button assembly having a plurality of buttons formed as one unit with a frame permits easy mounting/dismounting the button assembly to/from the control panel.

The character portions formed on a front of each buttons, or on outside surfaces of the control panel close to the buttons respectively by double injection molding improve endurance of the character portions, such that the character portions are not erased even if the character portions are brought into contact with a user's hand, frequently.

The position adjustment of the plurality of the buttons at the front of the control panel enables to form a good looking control panel.

The indicating units formed of a transparent material at a corner of each of the buttons for recognition of operation conditions of the laundry device by double injection molding permits user's easy recognition of the operation conditions and to improve endurance of the indication units.

The projection of the indicating unit from a front to a rear of the button, making a gap between the indicating unit and the LED lamp permits to minimize scattering of the light from the LED lamp and exposure of the light to an outside of the indicating unit.

The semispherical fore end of the indicating unit enhances an intensity of the light passing therethrough, the greater roughness of the outside circumferential surface of the indication unit can minimize scattering of the light from the outside circumferential surface. According to this, the user can sense the light more, clearly.

Since the button is not pressed, even if, not the button, but the control panel close to the button, is pressed, mal-operation can be prevented in advance.

BEST MODE FOR CARRYING OUT THE INVENTION

Figure 1:
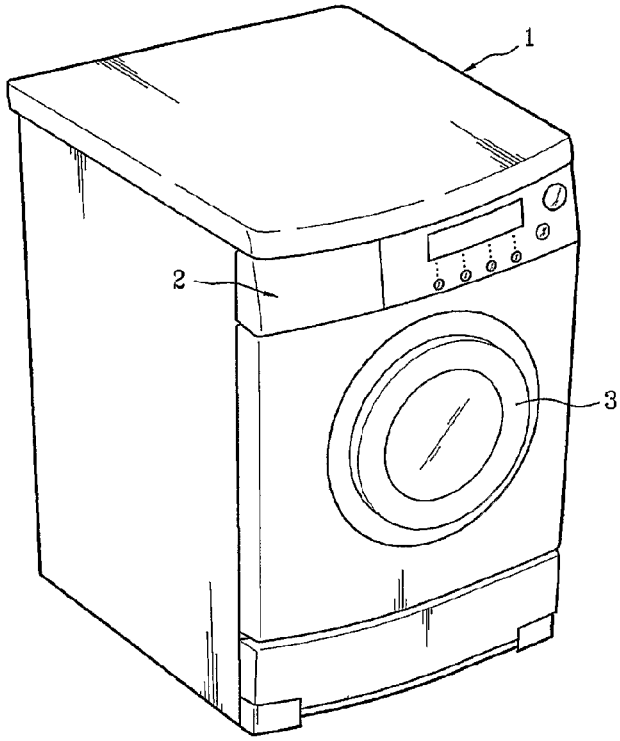
Related Art Fig. 1
FIG. 1 a perspective view of a related art dryer.
Figure 2:
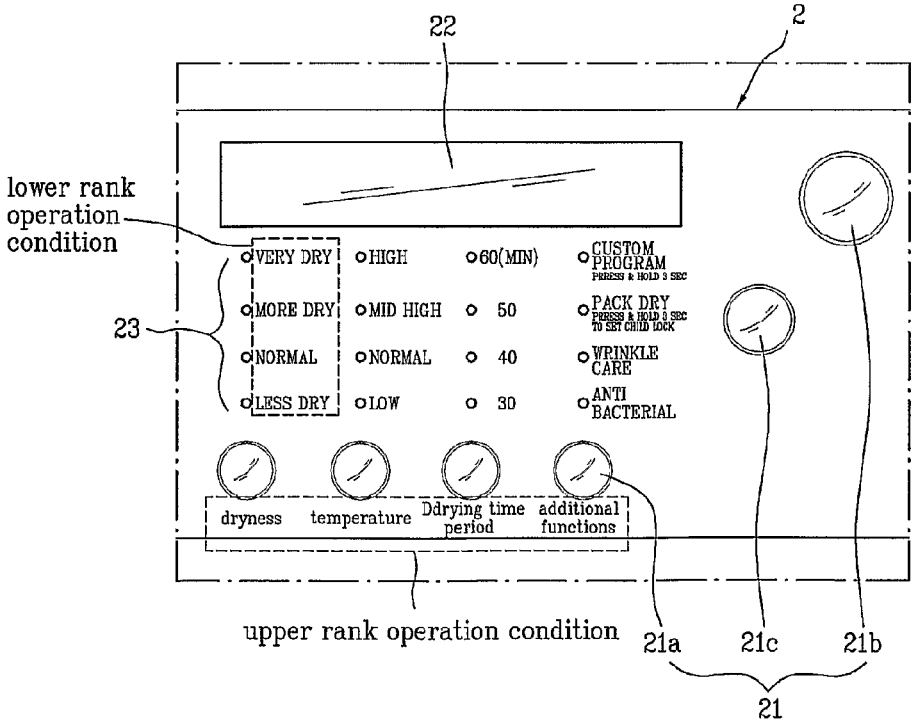
Related Art Fig. 2
FIG. 2 a front view of a related art control panel in a related art dryer.

Reference will now be made in detail to the specific embodiments of the present invention, examples of which are illustrated in the accompanying drawings FIGS. 3 to 6.

The present invention is applicable, not only to a dryer which dries laundry, but also to a washing machine which washes the laundry or a washing and drying machine. However, for convenience sake, the present invention will be described limited to the dryer taking as an example of the laundry device.

The control panel assembly of the present invention includes a control panel 100, a button assembly 200, a board guide 300, and a lamp supporter 400. Though it will be described later, by forming an element equivalent to the lamp supporter 400 on the button assembly 200 or the board guide 300, the lamp supporter 400 may be omitted.

The control panel 100 forms an exterior of the control panel assembly, and is detachably mounted to a front of the dryer. The control panel 100 has a plurality of mounting holes 110 for placing various input devices and indicating devices therein.

There may be character portions formed on an outside surface of the control panel 100 close to the mounting holes 110, for indicating operation conditions. The operation conditions are higher rank operation conditions (for an example, dryness, a drying time period, a temperature, and so on), and a plurality of lower rank operation conditions (for an example, perfect dry, 60 min. high, and so on), dependent on the higher rank operation conditions.

For an example, if a series of buttons are provided for selecting lower rank operation conditions that are detailed levels of the dryness which is the higher rank operation condition, the dryness, the higher rank operation condition, may be indicated with the character portions on the outside surface of the control panel close to the series of buttons. Of course, it may be indicated on the outside surface of the control panel with the character portions that the buttons are buttons for selecting specific lower rank operation conditions, respectively.

It is preferable that the character portions are formed by double injection molding on the control panel 100 so that the character portions are not erased despite of frequent contact of a user's hand. In other words, it is preferable that the double injection molding is made such that a material of the control panel and a material of the character portions are different from each other, or colors thereof are different from each other even if the materials are the same.

In the meantime, in the mounting holes 110 of the control panel, buttons 220 of the button assembly, which will be described later, will be placed.

On one side of the control panel 100, there is a display window 120 of a transparent material for displaying a progress state of the dryer. In this instance, mounted on a back side of the display window 120, there are display devices (not shown) for providing various kinds of information to the user. It is preferable that the display window 120 is constructed of LCD devices for displaying various kinds of image information.

Figure 4:
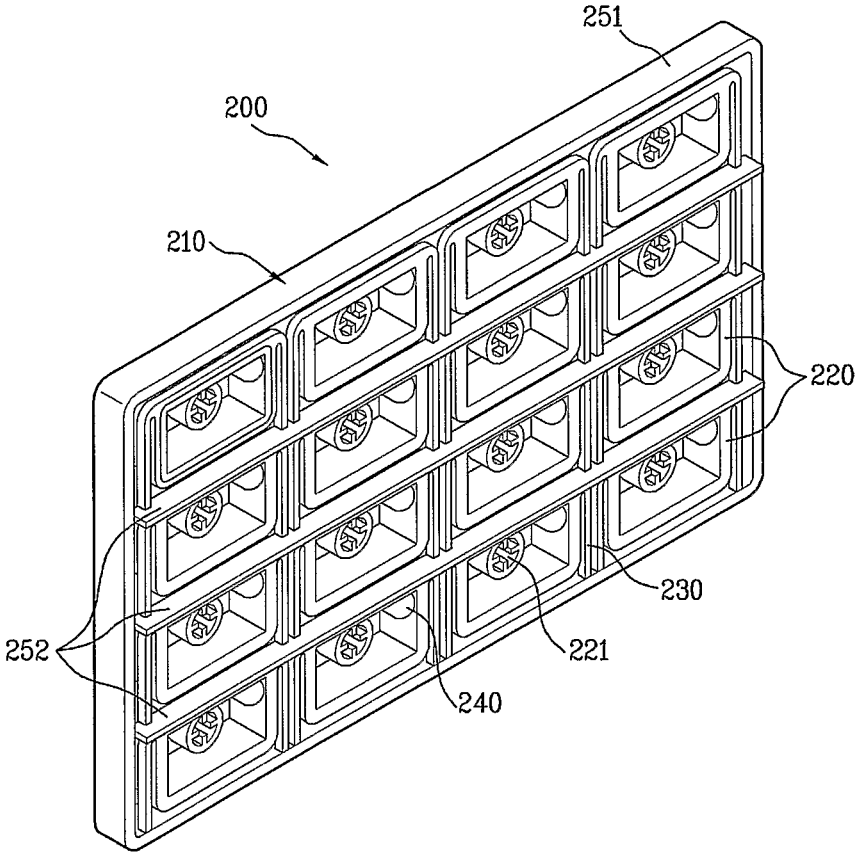
FIG. 4 illustrates a perspective view of a back side of the button assembly in FIG. 3.

The button assembly 200 is designed for the user to make an easy order of operation conditions to the dryer. As shown in FIG. 4, the button assembly 200 includes a frame 210, a plurality of buttons 220, elastic ribs 230, and display units 240.

The frame 210 may include an outer frame 251 which forms an external shape thereof, and an inner frame 252 arranged on an inside of the outer frame 251 in a width or height direction. Of course, depending on how the buttons are pressed, the inner frame may be arranged in the width and height directions. FIG. 4 illustrates the inner frame 252 arranged in the width direction.

The inner frame serves as supporting ribs when the buttons are pressed.

Figure 3:
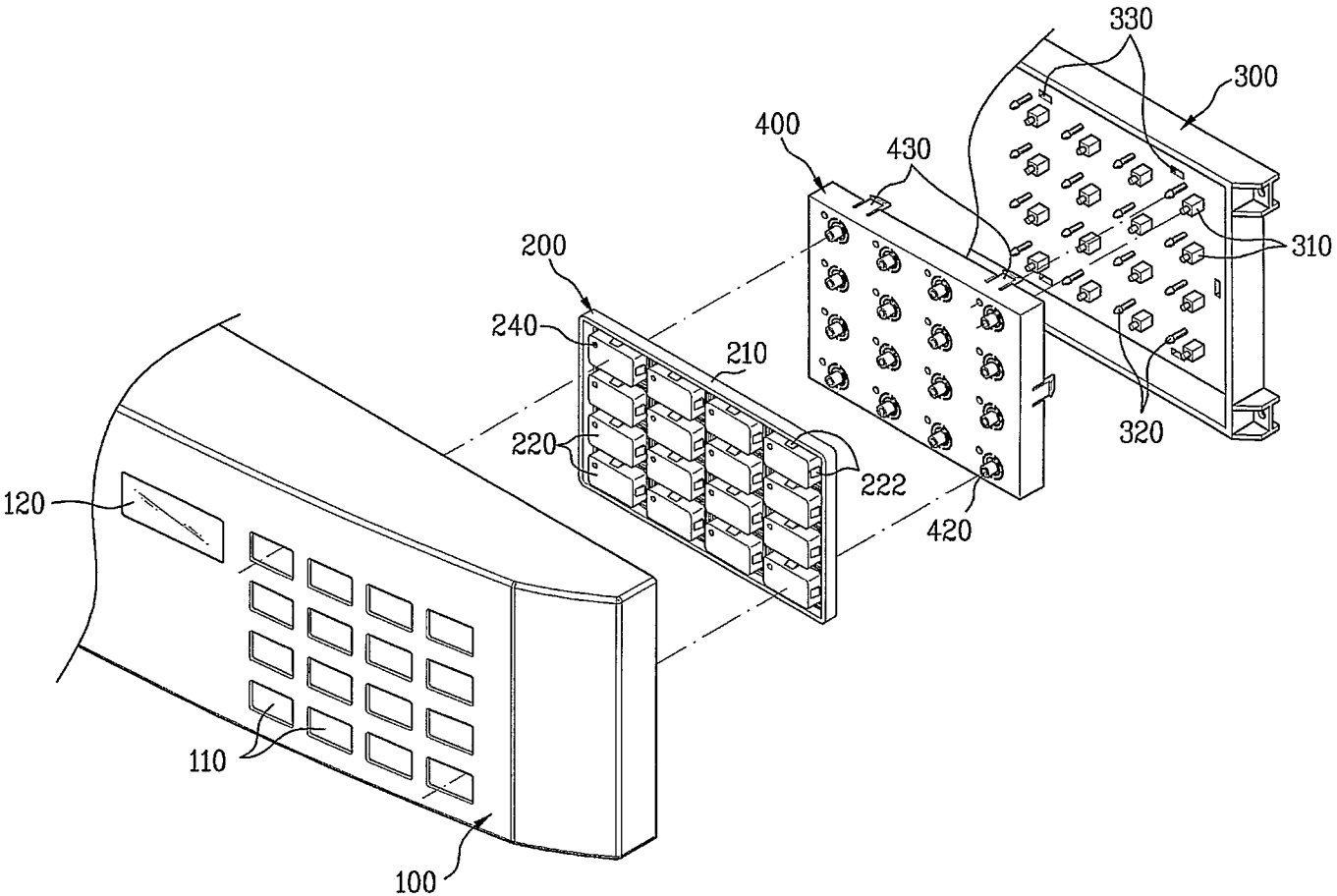
FIG. 3 illustrates an exploded perspective view of a control panel assembly in accordance with a preferred embodiment of the present invention.

In the meantime, the user selects an operation condition by using one of the buttons 220. That is, as shown in FIG. 3, the user presses a button projected from the mounting hole 110. However, there can be a case when the user presses not the button, but between the buttons. In other words, there can be a case when the user presses a front of the control panel 100 between the mounting holes 100. In this case, as the front of the control panel 100 is pressed backward, an adjacent button can be pressed, to select an operation condition that the user does not intend to select, resulting in malfunction.

In order to prevent this, it is required that the front of the control panel 100 having the mounting holes 110 formed therein is not pressed backward. That is, it is preferable that an interference preventive portion is formed to prevent pressing between the buttons.

In the present invention, there can be a variety of the interference preventive portions.

As an example, referring to FIG. 4, the interference preventive portion may be formed as one body with the inner frame 252. That is, the inner frame 252 can be projected more than a rear end of the button, preferably, with a projection height formed the same with a greatest rear direction distance.

Accordingly, though the button 220 is pressed, the pressing between the buttons can be prevented by the inner frame 252. That is, in FIG. 4, interference between the buttons arranged on an upper side and a lower side is prevented by the inner frame formed in the width direction. Therefore, though not shown, interference between the buttons arranged on a lateral direction can be prevented, if the inner frame is formed in the height direction.

A direction of arrangement of the inner frame 252 will depends on how supporting portions of the buttons 220 are formed. In a case the buttons 220 are pressed, not by rotation, but by a rear direction movement of whole button, the inner frame 252 can be formed in width and height directions.

It is preferable that the frame 210 forms a rim of the button assembly 200, and is rectangular for better sense of beauty. Each of the buttons 220 forms an exterior of the button assembly 200, and serves to receive the operation condition. The button 220 is arranged in the frame 210. It is preferable that the button 220 is rectangular exterior for being in harmony with an exterior of the frame 210.

That is, according to the present invention, it is very easy that one button assembly 200 has a plurality of buttons to form a whole control panel assembly. Moreover, according to the present invention, one button is matched to a specific operation condition in one to one fashion such that, if the user presses the specific button, a specific lower rank operation condition is selected, to select the operation condition, easily.

On a back side of the button 220, there is a projection 221 formed as one unit with the button 220 for moving down following press down of a front of the button 220. The projection 221 is projected backward from the bask side of the button 220. That is, if the user presses the button 220, the projection 221 moves backward, to press a tact switch 310 which will be described later. However, the projection may also be omitted. That is, a length of a pressing portion 420 of a lamp supporter 400 may be extended more, so that the back side of the button 220 may press the pressing portion 420 directly when the button 220 is pressed.

Figure 5:
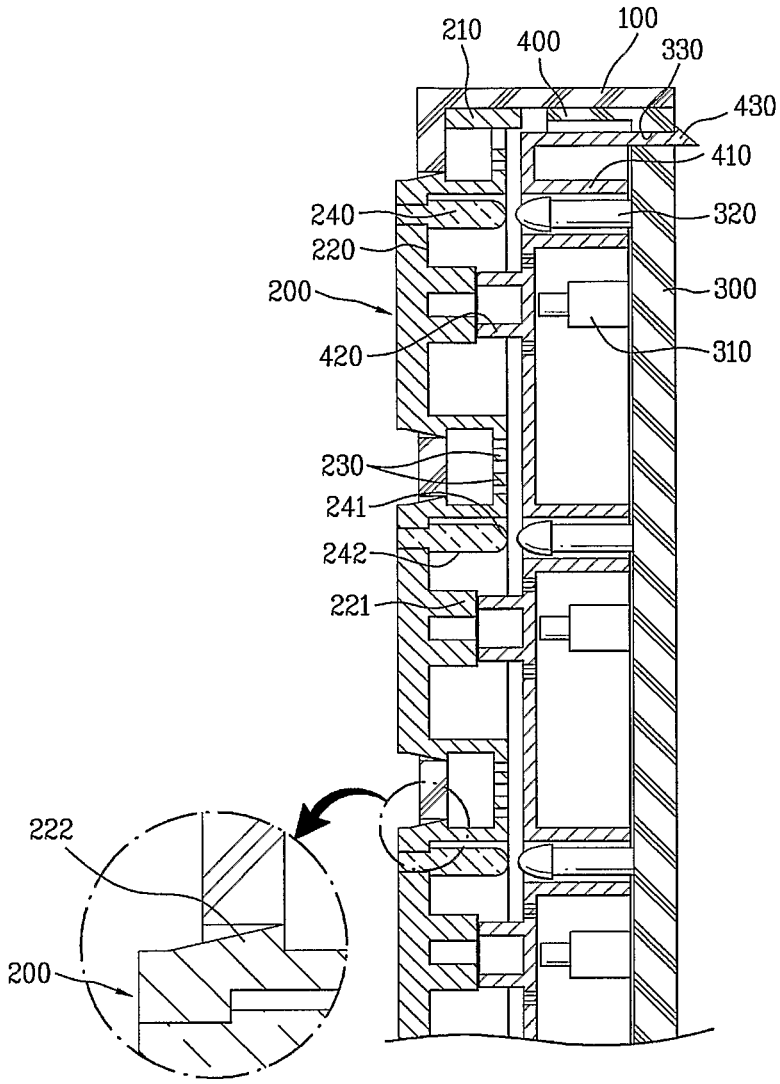
FIG. 5 illustrates a longitudinal sectional view of a control panel assembly in accordance with a preferred embodiment of the present invention.

In the meantime, referring to FIGS. 3 and 5, there are position adjusting ribs 222 at sides of the button. The position adjusting rib 222 adjusts a position of the button within mounting hole at the time the button 220 is placed in the mounting hole 110 in the control panel. That is, since the mounting hole 110 has a size greater than a size of the button 220, to leave a gap between the mounting hole and the button. However, if such gaps are not consistent, the front of the control panel appears not good. Accordingly, it is preferable that the gap between the mounting hole 110 and the button 220 is adjusted.

Moreover, since the buttons 220 are formed as one unit with the frame 210, the plurality of buttons 220 can have their positions adjusted within the plurality of mounting holes 110 by means of the position adjusting ribs 222, respectively.

The position adjusting ribs 222 may be provided on left/right sides of the button, or up/down sides of the button. Of course, the position adjusting ribs 222 may be provided to all of the left/right and up/down sides of the button, completely.

It is preferable that the position adjusting ribs 222 has a slope such that a projection height thereof is the greater as it goes to a rear of the button 220. This is for preventing pressing down of the button 220 from interfering with the position adjusting ribs 222, even though the gap between the mounting hole 110 and the button 220 is adjusted by means of the position adjusting ribs 222.

Figure 6:
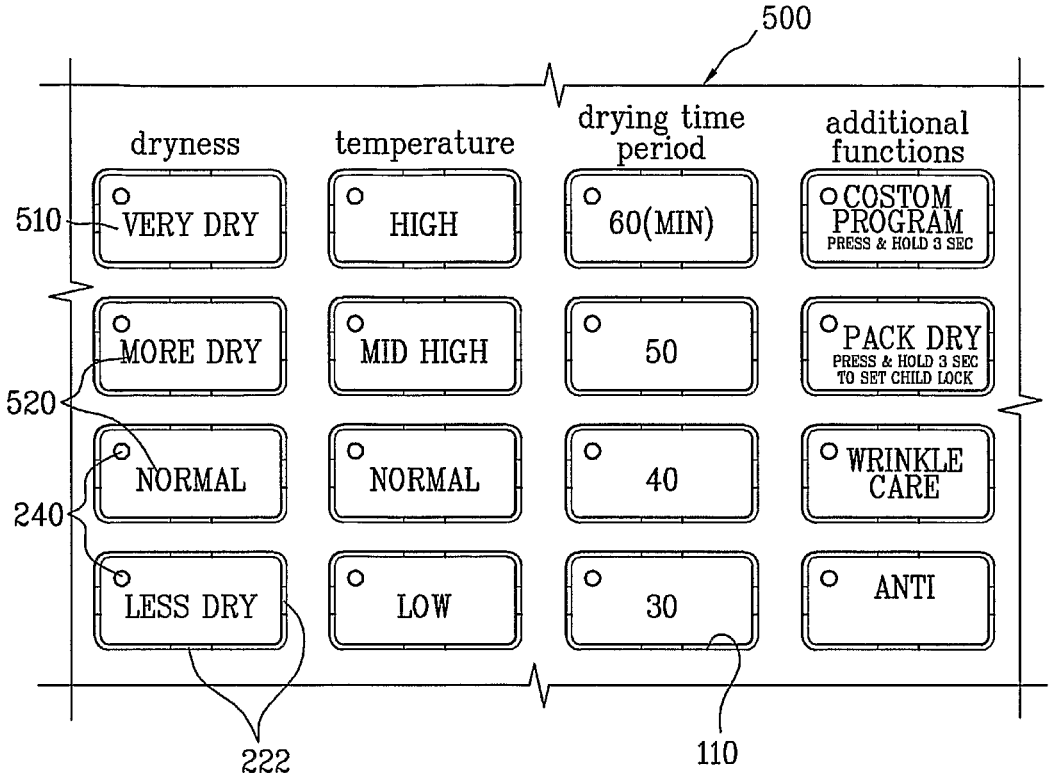
FIG. 6 illustrates a front view of a control panel assembly in accordance with another preferred embodiment of the present invention.

In the meantime, FIG. 6 illustrates positions of the buttons adjusted by means of the position adjusting ribs 222, well. As shown in FIG. 6, the position adjusting ribs 222 position the plurality of buttons 220 at centers of the plurality of mounting holes 110 in the front of the control panel 100, respectively. According to this, finish of the front of the control panel 100 can look good.

The elastic rib 230 connects button 220 to the frame 210 as one unit. The elastic rib 230 serves to move the button 220 in front/rear directions with elastic force while the button 220 is supported on the frame 210 at the time the button 220 is pressed down with force higher than a certain level.

It is preferable that the elastic rib 230 has a thickness thinner than a thickness of the frame 210 for optimization of the elastic force. That is, if one of the buttons 220 is pressed down, the button 220 moves in front and rear of the button assembly 200 while the button 220 is elastically supported on the elastic rib 230.

Referring to FIGS. 3 to 5, the indicating unit 240 serves to let the user recognize the operation condition selected with the button 220, and is formed at a corner of the front of the button 220. That is, it is preferable that the indicating unit 240 is formed at the button 220, because, if the indicating unit 240 is formed, not at the button 220, but on a front of the control panel 100, it is liable that the user is confused in one to one matching of a particular button with a particular indicating unit. Therefore, if the indicating unit 240 provided to the button 220 emits a light when the user presses the button 220, such confusion can be prevented in advance.

It is preferable that the indicating unit 240 is formed of a transparent material for transmission of the light to an outside of the indicating unit 240, and as one unit with the button 220 by double injection molding for improving endurance. Moreover, it is preferable that the indicating unit 240 is projected from a front to a rear of the button.

This is for making a gap between the indicating unit 240 and an LED lamp small for minimizing scattering of a light from the LED lamp.

In the meantime, it is preferable that a fore end of the indicating unit 240 opposite to the LED lamp is semi-spherical, for maximizing a surface area of the indicating unit 240 to which the light from the LED lamp is transmitted. That is, the surface area of the semi-spherical fore end 241 is greater than the surface area of a flat fore end 241, so that an intensity of the light from the LED lamp to the indicating unit becomes stronger for the user to recognize the light at the indicating unit more clearly.

It is preferable that roughness of the fore end 241 of the indicating unit 240 and roughness of an outside circumferential portion 242 of the indicating unit are different, so that the light transmitted from the LED lamp to the indicating unit 240 does not scatter.

Of course, it is also possible that the outside circumferential portion 242 of the indicating unit 240 is coated with a material that does not transmit the light. However, since it is preferable that a whole indicating unit 240 is formed of one transparent material for easy fabrication of the indicating unit 240, it is more preferable that the roughness of the surfaces differ.

That is, the fore end 241 of the indicating unit 240 is made to have very fine surface roughness for complete transmission of the light while the outside circumferential portion 242 of the indicating unit 240 is made to have coarse surface roughness for preventing transmission of the light.

Accordingly, the light received from the LED lamp through the fore end 241 of the indicating unit 240 lets the user to recognize more clearly, because the light does not spread or scatter through the outside circumferential portion 242 of the indicating unit.

The board guide 300 is mounted at a rear most position of the control panel assembly, and close to which a circuit board (not shown) having circuit components (not shown) mounted thereon is mounted for controlling the dryer.

The board guide 300 serves to transmit the operation condition of the dryer to the circuit board as the button 220 is pressed.

Mounted on the board guide 300, there are tact switches 310 connected to the circuit components electrically, and the LED lamps 320 in a number the same with the tact switches 310.

The LED lamp 320 is mounted such that the LED lamp 320 emits a light if the tact switch 310 is pressed down, and the LED lamp 320 is mounted opposite to the indicating unit 240 of the button assembly 200.

It is preferable that, at a periphery of the board guide 300, there are fastening holes 330 for securing the lamp supporter 400.

The lamp supporter 400 serves to prevent the light from the LED lamp 320 from scattering, and transmit the operation condition selected as the button 210 is pressed down to the tact switch 310.

The lamp supporter 400 is mounted between the button assembly 200 and the board guide 300, and has lamp guide bosses 410 and the pressing portions 420.

It is preferable that the lamp guide boss 410 is projected backward from a back side of the lamp supporter 400, and surrounds the LED lamp 320. It is more preferable that the lamp guide boss 410 has a length to let the fore end of the LED lamp 320 projected beyond the LED lamp 320 slightly when the lamp guide boss 410 surrounds the LED lamp 320, for preventing the light from the LED lamp 320 from scattering, but being guided to the indicating unit 240.

The pressing portion 420 is designed such that a rear thereof presses the tact switch 310 as the pressing portion 420 is pressed by the projection 221 at the button assembly 200. It is preferable that the pressing portion 420 is projected forward from the front of the lamp supporter 400, for making exact match of the plurality of projections 221 to the pressing portions 420, respectively.

It is preferable that the pressing portion 420 has a portion adjacent thereto a portion of which is incised, for providing greater elastic force in moving in the front/rear directions.

The lamp supporter 400 has a plurality of hooks 430 at a circumference for hooking to the fastening holes 330 in the board guide 300. Of course, as fastening means for fastening the lamp supporter 400 to the board guide 300, not the hook fastening means, but other fastening means, may be provided.

As described before, the lamp supporter 400 that supports the plurality of lamp 320 is formed as one body, which permits an easy assembly of the control panel assembly.

In the meantime, the pressing portion 420 may be formed as one unit with the button, and the lamp guide boss 410 can be formed as one unit with the board guide 300. In this case, the lamp supporter 400 can be omitted.

Assembly of the control panel assembly will be described.

At first, the button assembly 200 is mounted to an inside of the control panel 100.

In this instance, the buttons 220 are placed in the mounting holes 110 in the control panel 100 respectively, and, though not shown, the frame 210 is secured to an inside of the control panel 100 with fastening means, such as hooks on the frame 210. The gap between the mounting hole 110 and the button 220 is adjusted with the position adjusting rib 222, to adjust a position of the button 220 within the mounting hole 110.

In this instance, the front of the button 220 is exposed to an outside of the control panel 100, and it is preferable that the button 220 has a color the same with a color of the control panel 100 in light of fine view.

Moreover, since the button assembly 200 is a single unit of the frame 210, the button assembly 200 can be mounted to the mounting hole 110 of the control panel 100 at a time without taking a plurality of times.

Next, the lamp supporter 400 is mounted to the board guide 300 as the hooks 430 on the lamp supporter 400 are hooked in the fastening holes 330 in the board guide 300. In this instance, the LED lamps 320 on the board guide 300 are placed in the lamp guide bosses 410 on the lamp supporter 400, respectively.

The tact switches 310 on the board guide 300 are positioned close to rears of the pressing portions 420 of the lamp supporter 400, respectively.

Next, the board guide 300 is mounted to a rear side of the control panel 100. In this instance, the lamp guide bosses 410 respectively surrounding the LED lamps 320 are mounted close to the rears of the indicating units 240 in a horizontal direction.

Thus, assembly of the control panel assembly of the laundry device in accordance with a first preferred embodiment of the present invention is completed.

An operation of the control panel assembly assembled thus will be described.

Upon pressing a button 220 of an intended operation condition, the button 220 moves in a rear direction of the button assembly 200 while the button 220 is supported on the elastic rib 230, elastically.

In this instance, since the frame 210 is secured to the inside of the control panel 100, the button assembly 200 does not fall off when the button 220 is pressed.

Then, the projection 221 on the back side of the button 220 presses the front of the pressing portion 420 of the lamp supporter 400. The pressing portion 420, pressed by the projection 221, presses the tact switch 310 as the pressing portion 420 moves in a rear direction of the lamp supporter 400.

In this instance, since a portion of an adjacent portion of the pressing portion 420 is incised, the pressing portion 420 moves in a rear direction of the lamp supporter 400 with an elastic force of the incised portion. The tact switch 310 pressed by the pressing portion 420 transmits an operation signal to the circuit board, and, at the same time with this, the LED lamp 320 emits a light.

The light from the LED lamp 320 transmits to an outside of the button assembly 200 through the indicating unit 240, and the user recognizes the light to determines whether the user gives right operation to the dryer or not.

In the meantime, even if the user presses, not the button, but the front of the control panel in the vicinity of the button, pressing of the button is prevented by means of the interference preventive portion between the buttons on the rear of the control panel.

Up to now, in the first preferred embodiment of the present invention, character portions has been reviewed, which are formed on an outside surface of the control panel 100 close to the button assembly 200 for indicating a selected operation condition of the dryer.

An indicating unit in accordance with another preferred embodiment of the present invention will be described with reference to FIG. 6.

A control panel assembly of a dryer in accordance with the embodiment of the present invention includes a control panel (see FIG. 3), a button assembly 500, a board guide 300 (see FIG. 3), a lamp supporter 400 (see FIG. 4).

All other elements are the same with the elements of the foregoing embodiment, excluding the button assembly 500.

The button assembly 500 includes buttons 510 and character portions 520 on fronts of the buttons 510 indicating specific operation conditions, wherein it is preferable that each of the character portions 520 is formed on a front surface of the button 510 by double insert injection molding for improving endurance of the character portions 520.

Referring to FIG. 6, the button assembly 500 may have a plurality of the buttons arranged in four rows. That is, the leftmost 4 buttons may be arranged to select lower rank operation conditions which are detailed dry levels on dryness that is an upper operation condition. The lower conditions are indicated with the character portions 520 on the buttons. The dryness and so on which are the upper rank operation conditions may be indicated on an upper side or a lower side of a series of buttons on the front of the control panel. Accordingly, only by pressing a specific button for selecting very dry, the user can select the operation condition.

In this instance, alike to the first embodiment, an indicating unit 240 is formed at a front corner of a front of the button 510 by double injection molding for indicating a selected operation condition. By this, the button assembly 500 of the embodiment permits user's easy recognition of the operation condition.

By making double injection molding of the indicating unit and the character portion that indicate operation conditions, the control panel assembly of the dryer in accordance with the embodiment of the present invention permits user's easy recognition of the operation condition by means of the buttons, and improve endurance of the indicating unit and the character portion.

Figure 7:
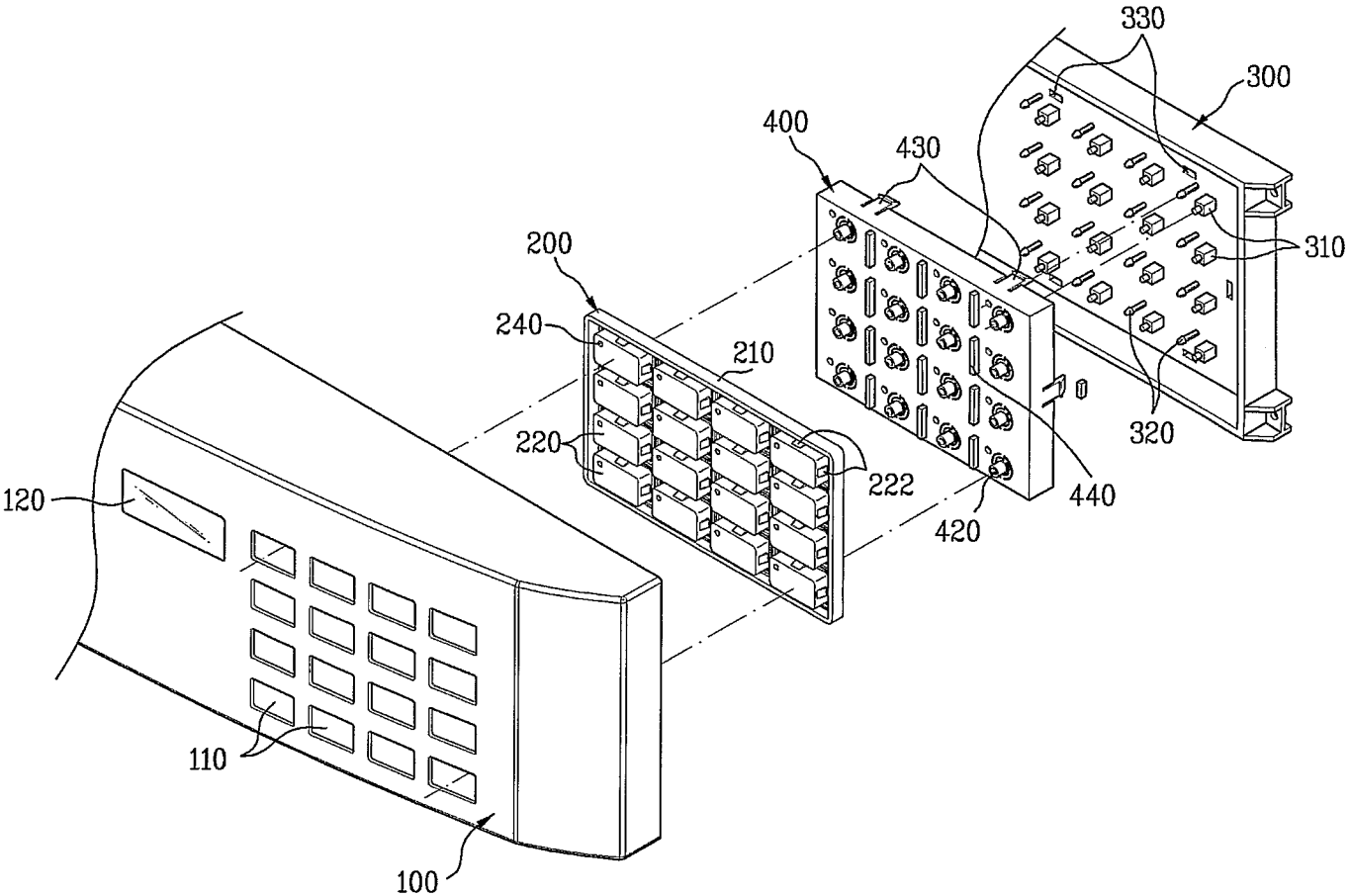
FIG. 7 illustrates an exploded perspective view of a control panel assembly in accordance with another preferred embodiment of the present invention.

Another embodiment of the present invention will be described with reference to FIG. 7.

FIG. 4 illustrates an interference preventive portion formed on the inner frame 252 for preventing adjacent buttons from causing interference.

Different from above, the embodiment has the interference preventive portion formed on the lamp supporter 400. That is, the interference preventive portion is projected from an upper surface of the lamp supporter opposite to a position between adjacent buttons for preventing the buttons from causing interference between the buttons.

That is, in the embodiment, the rib 400 projected from the upper surface of the lamp supporter 400 is formed as the interference preventive portion.

In the meantime, the rib 400 can serve as the interference preventive portion together with the inner frame 252 shown in FIG. 4. For this, the rib 400 is not formed at a portion where the inner frames cross. According to this, the rib 400 performs interference prevention between adjacent buttons in a width direction, and the inner frame 252 performs interference prevention between adjacent buttons in a height direction.

As described before, the lamp supporters 400 can be omitted if required. In this case, the interference preventive portion may be formed, not at the lamp supporter 400, but at the board guide 300. This case will not be shown or described separately because this case is the same with a case the interference preventive portion is mounted to the lamp supporter 400.

The foregoing embodiments take dryers as examples. However, the present invention is not limited to the dryers. For an example, the present invention can also be applied to a washing machine.

The upper rank operation conditions and the lower rank operation conditions of the foregoing dryers are also applicable to the washing machine alikely. For an example, if the upper rank operation condition is a washing time period, detailed lower operation conditions therefore can be set up. If the upper rank operation condition is a spinning RPM, specific spinning RPM's can be set up as the lower rank operation conditions.

INDUSTRIAL APPLICABILITY

The plurality of buttons provided in a number the same number with a plurality of operation conditions permits user's easy operation of the buttons because what is required is to press the buttons only once for each time of operation.

The single button assembly having a plurality of buttons formed as one unit with a frame permits easy mounting/dismounting the button assembly to/from the control panel.

The character portions formed on a front of each buttons, or on outside surfaces of the control panel close to the buttons respectively by double injection molding improve endurance of the character portions, such that the character portions are not erased even if the character portions are brought into contact with a user's hand, frequently.

The indicating units formed of a transparent material at a corner of each of the buttons for recognition of operation conditions of the laundry device by double injection molding permits user's easy recognition of the operation conditions and to improve endurance of the indication units.

The projection of the indicating unit from a front to a rear of the button, making a gap between the indicating unit and the LED lamp permits to minimize scattering of the light from the LED lamp and exposure of the light to an outside of the indicating unit.

The semispherical fore end of the indicating unit enhances an intensity of the light passing therethrough, the greater roughness of the outside circumferential surface of the indication unit can minimize scattering of the light from the outside circumferential surface. According to this, the user can sense the light more, clearly.

The invention claimed is:

1. A control panel assembly comprising:

a control panel having a plurality of mounting holes;

a button assembly including:

a plurality of buttons provided in a number the same with a number of a plurality of operation conditions for being exposed from a front of the control panel through the mounting holes; and a frame on a rear of the control panel for joining the plurality of buttons as one unit within the frame;

a lamp supporter for guiding an LED light to an indicating unit, the lamp supporter provided at a rear of the button assembly; and an interference preventive portion for preventing pressing interference between adjacent buttons;

wherein the interference preventive portion projects forward from a front surface of the lamp supporter so that the interference preventive portion is between the rear of the button assembly and a front surface of the lamp supporter.

2. The control panel assembly as claimed in claim 1, wherein each button includes an indicating unit for indicating an operation condition selected as the button is pressed.

3. A control panel assembly comprising:

a control panel having a plurality of mounting holes;

a button assembly including:

a plurality of buttons provided in a number equal to a number of a plurality of operation conditions for being exposed from a front of the control panel through the mounting holes; and a frame on a rear of the control panel for joining the plurality of buttons as one unit within the frame;

a board guide having switches to be switched as the buttons are pressed respectively; and an interference preventive portion for preventing pressing interference between adjacent buttons;

wherein the interference preventive portion projects forward from a front surface of the board guide so that the interference preventive portion is between the rear of the button assembly and a front surface of the board guide.

4. The control panel assembly as claimed in claim 3, wherein each button includes an indicating unit for indicating an operation condition selected as the button is pressed.

* * * * *